US006244089B1

(12) United States Patent
Schoenau et al.

(10) Patent No.: US 6,244,089 B1
(45) Date of Patent: Jun. 12, 2001

(54) EMBOSSING DEVICE FOR EMBOSSING THE EDGE OF ROUND BLANKS

(75) Inventors: Hein Schoenau, Salach (DE); John Stobart, Mid Glamorgan (GB)

(73) Assignee: Schuler Pressen GmbH & Co. KG, Goeppingen (DE)

( * ) Notice: Subject to any disclaimer, the term of this patent is extended or adjusted under 35 U.S.C. 154(b) by 0 days.

(21) Appl. No.: 09/406,090

(22) Filed: Sep. 24, 1999

(30) Foreign Application Priority Data

Sep. 24, 1998 (DE) ..... 198 43 760

(51) Int. Cl.[7] ..... B21D 15/00
(52) U.S. Cl. ..... 72/108; 72/92; 72/107
(58) Field of Search ..... 72/92, 104, 107, 72/108, 86, 110

(56) References Cited

U.S. PATENT DOCUMENTS 2,909,952 * 10/1959 Moeltzner ..... 72/104
3,691,806 * 9/1972 Hanzawa ..... 72/92
4,546,630 * 10/1985 Sakamura ..... 72/92
4,779,437 * 10/1988 Kubiak ..... 72/108
4,811,585 * 3/1989 Takahashi et al. ..... 72/108

FOREIGN PATENT DOCUMENTS 57-39053 * 3/1982 (JP) ..... 72/86

* cited by examiner

*Primary Examiner*—Ed Tolan
(74) *Attorney, Agent, or Firm*—Evenson, McKeown, Edwards & Lenahan, P.L.L.C.

(57) ABSTRACT

A device for embossing the edge of round blanks, in particular coins, has a forming wheel which is provided with roll-forming segments. The forming wheel has associated abutment elements which may likewise be mounted on forming wheels. A positioning device guides the round blanks, in coordination with the equally directed synchronous rotation of the forming wheels between the forming wheels and, after edge embossing has taken place out of the wheel interspaces.

11 Claims, 3 Drawing Sheets

EMBOSSING DEVICE FOR EMBOSSING THE EDGE OF ROUND BLANKS

BACKGROUND OF THE INVENTION

This application claims the priority of 198 43 760.9, filed Sep. 24, 1998, the disclosure of which is expressly incorporated by reference herein.

The present invention relates to a device for reforming, in particular for embossing, the edge of ring-shaped or disc-shaped blanks.

Particularly in coin production, but also in other instances of use, it may be necessary to deform a flat disc-shaped blank at its edge. If, for example in the production of medals or coins, round or polygonal disc-shaped blanks have first been stamped out of a sheet of suitable material (e.g., metal), they have, at their edge, a stamping burr and a parting plane which originates from the stamping operation. In many cases, blanks of this kind cannot be embossed immediately on the flat side.

In particular, embossing cannot occur when the nature of the outer edge of the blank has to meet special quality requirements, as is often the case with coins. Moreover, there is occasionally the need to be able to design the edge in a specific way. For example, coins often have a thickened or raised edge which forms an annular rib projecting above the flat sides of the coin. The formation of such a rib makes it necessary to carry out, on the edge, an upsetting operation in which material is pressed inwards in the radial direction.

Furthermore, coins with knurling or edge lettering or any other raised or recessed edge structure are in use. Edge lettering can likewise be produced only by machining the coin in the radial direction. Coins, in which, for example, raised lettering is made in a recessed groove on the edge of the coin, are particularly demanding. Coins of this kind are shaped on the edge of the round blank. The length of the abutment element is at least such that the abutment element and the roll-forming segment completely reform the circumference of the round blank. If no edge lettering or no other raised formed elements are to be produced on the round blank, the circumference of the round blank may be rolled more than once.

If the lengths of the abutment element and of the roll-forming segment are coordinated so that the complete circumference of the round blank touches the reforming elements exactly once, raised formed elements may also be produced on the round blank. Consequently, part of the circumference of the round blank is formed or determined by the roll-forming segment of the forming wheel and another part of the round blank is formed or determined by the abutment element. This avoids one and the same edge region of a coin or round blank being rolled more than once.

SUMMARY OF THE INVENTION

An object of the present invention is to provide a device for embossing the edge of the round blanks by making continuous rotation of the forming wheel and therefore high productivity possible. Coins or other blanks are fed intermittently to the forming wheel which, together with a further forming wheel or another abutment element, produces an embossing nip. The feed is coordinated with the angular position of the roll-forming segment. The feed takes place, in this respect, in phase with the rotation of the forming wheel.

A plurality of roll-forming segments can be provided on a forming wheel so that, during each revolution of the forming wheel, a plurality of coins or round blanks are embossed at their edge. A high output and machining of very large batches with uniform quality are thus made possible.

In order to guide the coins or round blanks during the embossing process, a positioning device can be provided to at least partially perform the function of feeding the coins or round blanks to the embossing station and of leading them away from the latter. The positioning device is formed, for example, by a plate ring or carrier ring which is mounted essentially concentrically to the forming wheel and which has receiving pockets for the round blanks. The receiving pockets are preferably configured so that the round blanks can be inserted into the pockets by simple slide devices.

If the embossing of the edge of the round blanks takes place on the station, for example between two forming wheels, the positioning device guides the round blanks to this station in coordination with the rotation of the forming wheel, waits there during the embossing operation and thereafter guides the round blanks, by further rotation, out of the embossing station which is located between the two forming wheels.

In an embodiment with a fixed abutment element, the positioning device guides the round blank through the embossing nip formed between the abutment element and the forming wheel. The rotational speed of the positioning device corresponds, to the speed at which the round blank would roll through the embossing nip automatically under the action of the forming wheel. The positioning device may be appropriately coordinated in terms of its transport speed or else freewheel, so that it is finally taken up (driven) by the round blank.

In both embodiments, the positioning device allows the round blanks to rotate freely in the receiving pockets without any slip and driven by the forming wheel. If non-round, for example octagonal, rose-shaped or other coins differing from the circular shape are to be embossed at their edge, it may be necessary to lay the round blanks into the receiving pockets of the positioning device in a fixed angular position. It may be expedient, in this situation, to fix the round blanks against rotation, at least as long as they are not in engagement with the forming wheel or the abutment element. Clamping claws, vacuum suckers, magnetic holders or other controllable holding devices can serve this purpose.

The forming wheel can be provided with roll-forming segments both on its outer circumference and on its flat side. If the forming segments are arranged on the outer circumference, a plurality of forming wheels can cooperate in a simple way. For example, a middle forming wheel may be assigned two forming wheels serving as abutments, all of the forming wheels being driven in the same direction and their shafts being oriented parallel to one another. Simple conditions arise as a result thereof.

For example, the drive is possible via a common shaft which runs transversely to the three forming-wheel shafts. This at the same time affords a simple possibility of adjusting the nip of the forming wheels relative to one another. If the bearing of the middle forming wheel is arranged, for example, at a fixed location, the bearings of the outer forming wheels may be arranged so as to be displaceable away from the middle forming wheel and towards the latter. This makes it possible, in addition to exchanging the roll-forming segments, to adapt to different coin or round-blank diameters in a simple way and without difficulty.

BRIEF DESCRIPTION OF THE DRAWINGS

Other objects, advantages and novel features of the present invention will become apparent from the following detailed description of the invention when considered in conjunction with the accompanying drawings.

DETAILED DESCRIPTION OF THE DRAWINGS

Figure 1:
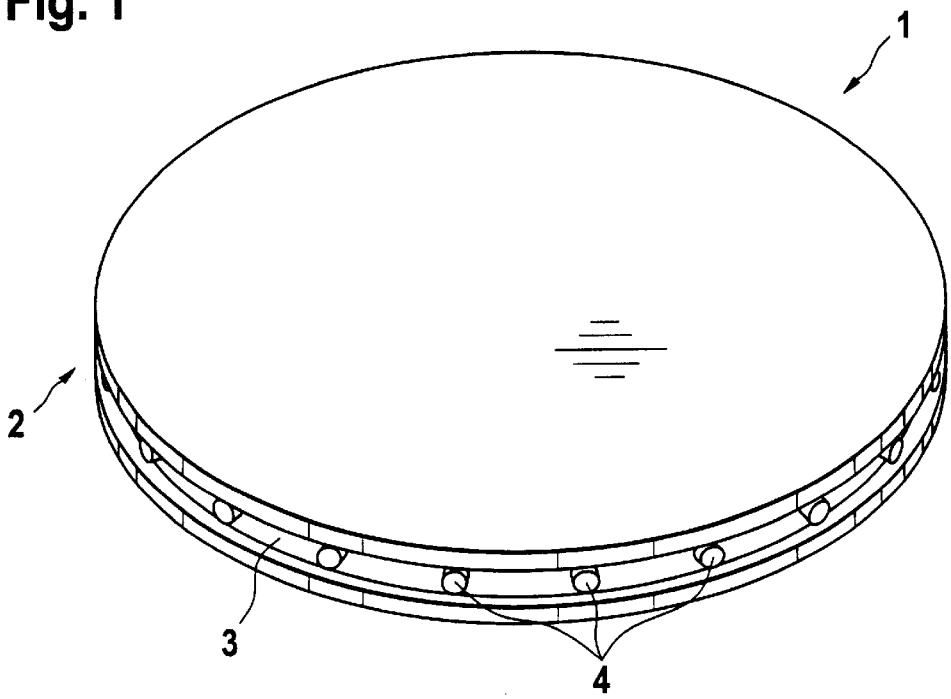
FIG. 1 is a schematic perspective view of a round blank provided with edge embossing.

FIG. 1 shows a round blank 1, the edge 2 of which is provided with embossing. The embossing is formed by a peripheral groove or slot 3, on the bottom of which raised elements, for example lettering, are produced. In FIG. 1, the raised elements are indicated by relatively small projections 4 arranged on the slot bottom. Instead of the projections 4, however, depressions, slot interruptions, stars, letters or other formed elements or symbols may also be provided. Moreover, the edge 2 of the round blank 1 may be designed without a slot. In the present example, the round blank 1 is circular, as seen in a top view, but it may also have a shape differing from the circular shape, for example a polygonal shape with rounded corners or a rose shape.

Figure 2:
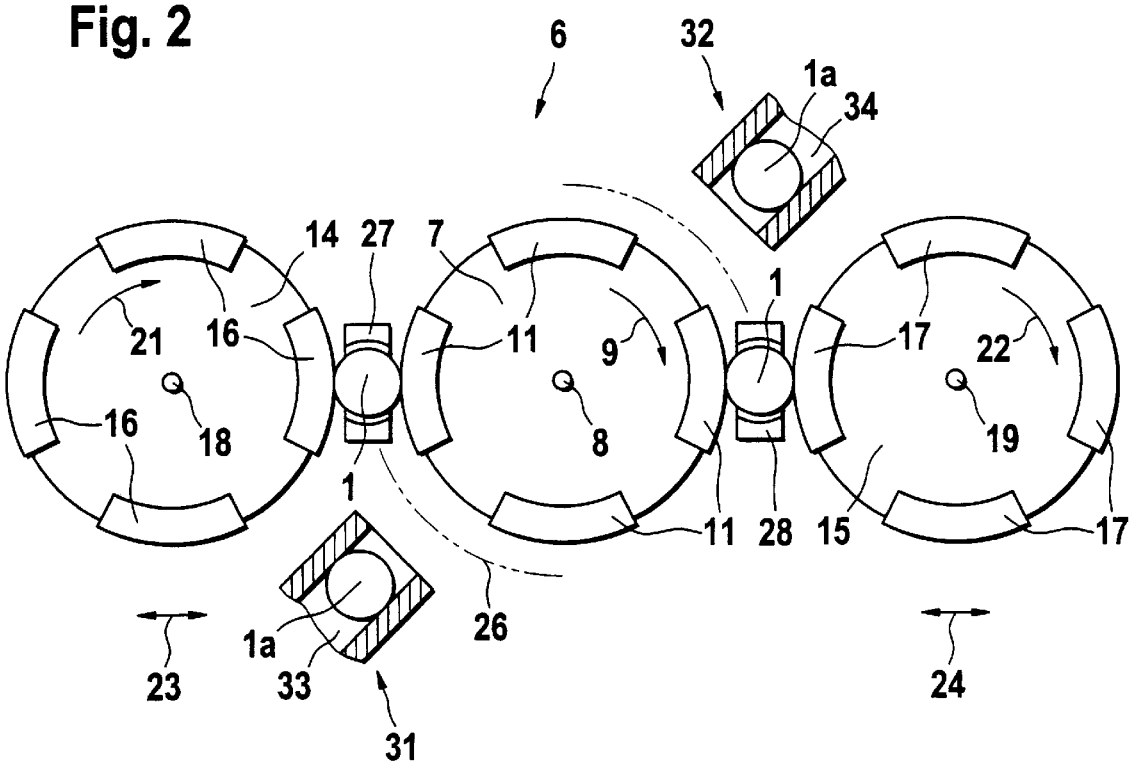
FIG. 2 is a schematic top view of a device for embossing the edge of round blanks of the type shown in FIG. 1.

The device 6 shown in FIG. 2 serves for producing the embossed edge 2 on the round blank 1. The device 5 includes a central forming wheel 7 which is mounted rotatably about an axis 8. The forming wheel 7 is driven continuously by a drive in a direction of rotation illustrated by an arrow 9.

Arranged on the forming wheel 7 at a distance from one another in a circumferential direction are one or more, for example four, six or eight, roll-forming segments 11 which may be mounted so as to be radially displaceable for adjustment purposes. Each roll-forming segment 11 has a negative form for embossing the edge of the round blank 1 illustrated in FIG. 1.

The corresponding profile extends in the circumferential direction over the respective roll-forming segment 11. The length of this profile corresponds approximately to half the circumference of the round blank 1. The roll-forming segments 11 may be exchangeable in order to make it possible to adapt to different round blanks 1, that is to say different diameters and edge profiles. The forming wheel 7 is associated with two further forming wheels 14, 15 which in each case form an abutment when the round blanks 1 are being embossed.

The forming wheels 14, 15 are essentially identical to the forming wheel 7. They are likewise provided with roll-forming elements 16, 17 which in each case have a forming profile assigned to half the circumference of the round blank 1. The roll-forming element 16 or 17 supplements the profile of the respective roll-forming element 11 to form a complete circumferential profile of a round blank 1. The roll-forming segments 16, 17 are mounted on the forming wheels 14, 15 so as to be likewise radially displaceable, thereby making the device 6 accurately adjustable. Moreover, the forming wheels 14, 15 are mounted rotatably about rotation axes 18, 19. The drive to drive the forming wheel 7 is preferably likewise coupled to the forming wheels 14, 15 and, as illustrated by arrows 21, 22, drives these in the same direction as the forming wheel 7, at the same rotational speed and in a fixed phase relationship.

Moreover, the forming wheels 14, 15 are preferably displaceable towards and away from the forming wheel 7 so that the distance between the forming wheels 14, 15 and the forming wheel 7 arranged between them can be adjusted. This is symbolized in FIG. 2 by arrows 23, 24. An embossing station, at which the reforming of the round blank 1 takes place is defined, in each case at the narrowest point, between the forming wheel 7 and the forming wheel 14 or the forming wheel 7 and the forming wheel 15. The embossing station is defined by the center point of the round blank 1 lying in each case on a straight line with the rotation axes 8, 18 or 8, 19. A plate 26, which is connected to a separate drive, is arranged, and rotatably mounted, concentrically to the forming wheel 7. The carriers 27, 28, which can receive round blanks 1, are mounted on the plate 26. For this purpose, the carriers 27, 28 are provided with corresponding receiving pockets which are open both radially inwards and radially outwards. A round blank 1 located in the respective receiving pocket is exposed in each case on its edge region facing the forming wheel 7 and on its respective edge region facing the forming wheel 14 or 15 and is therefore accessible. Moreover, the respective receptacle 27, 28 is such that the round blanks 1 can rotate freely in the receiving pocket. They are, however, mounted or supported in the axial direction.

The drive associated with the plate 26 is set up to accelerate and decelerate the plate 26 relatively smoothly. This movement is coordinated with the constant rotation of the forming wheel 7 which rotates synchronously with the forming wheels 14, 15, the forming wheel 7 being connected to the forming wheels 14, 15 in phase.

In order to feed blanks la to the receptacles 27, 28 of the plate 26, feeds 31, 32 push the individual blanks 1*a* radially inwards into the receptacles 27, 28 or their pockets, when these are aligned with the feeds 31, 32. The feeds 31, 32 can each have the duct 33, 34 which is adapted to the dimensions of the blank 1*a* and in which the blanks 1*a*, lying flat, are pushed into the respectively aligned pocket of the receptacles 27, 28 when the pocket is in front of the mouth of the feed 31, 32.

Figure 3:
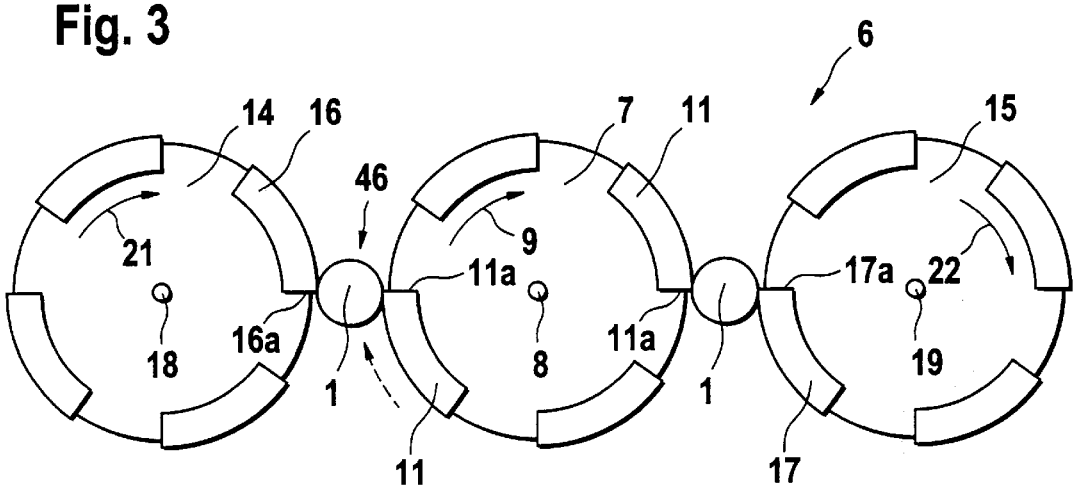
FIGS. 3 to 5 are schematic top views of the device similar to FIG. 2 but in different work stages.
Figure 4:
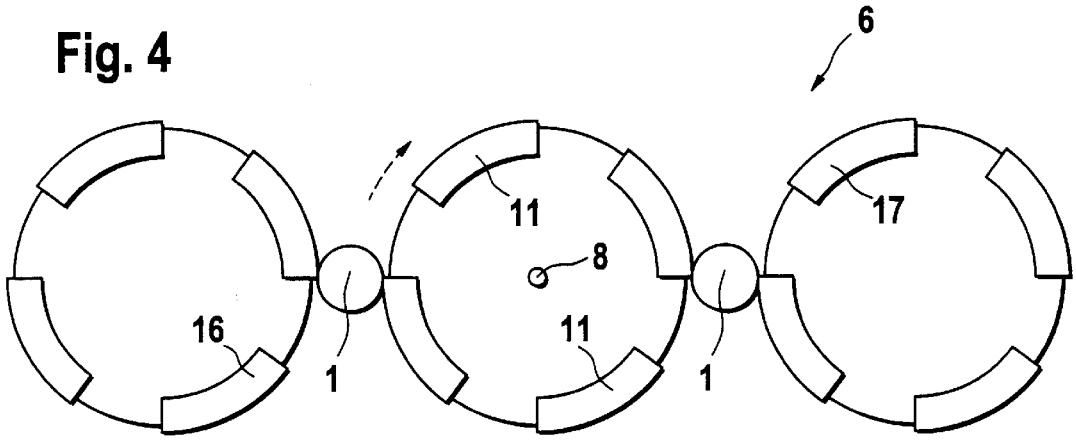
Figure 5:
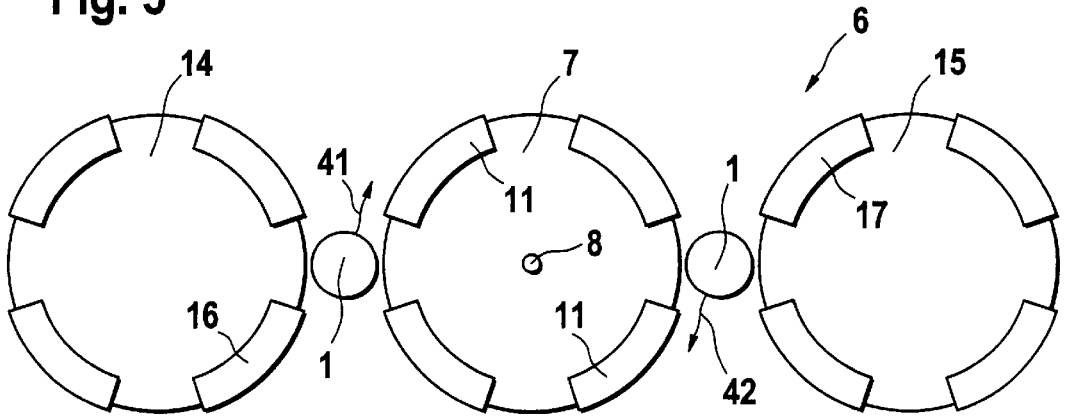

Reference is made, for illustrative purposes, to FIGS. 3 to 5, which are even further simplified to describe operation of the device 6. The movement of the plate 26 is coordinated with the rotation of the forming wheels 7, 14, 15, such that the still undeformed round blank 1 has arrived in an embossing position 46 when the respective starts 16*a*, 11*a* of the roll-forming segments 16, 11 are located opposite one another. The starts 11*a*, 16*a* form one line with the center point of the round blank 1 and the rotation axes 8, 18. The starts 11*a*, 17*a* accordingly lie on one line with the rotation axes 8, 19 and the center point of the round blank 1 held between the forming wheels 7, 15. The plate 25 stops in this position, so that the freely rotatably mounted round blanks 1 wait at this point. The rotation of the forming wheels 7, 14, 15 is then continued in the direction of the arrows 9, 21, 22, until the roll-forming segments 11, 16 and 17, 11 are rolled completely on the edge of the round blank 1. Each round blank 1 thus has executed exactly half a revolution. The result of the rolling movement is illustrated in FIG. 4. The profiles of the roll-forming segments 11, 16 and 17, 11 have been shaped on the edge of the round blank 1 which, for example, may have assumed the form illustrated in FIG. 1.

When the roll-forming segments 11, 16 and 17, 11 have come out of engagement with the round blanks 1 as a result of the further rotation of the forming wheels 7, 14, 15, the plate 26 is accelerated about the axis of rotation 8, with the result that the round blanks are lead out of the embossing spaces between the forming wheels 7, 14, 15, as illustrated by arrows 41, 42. New round blanks 1 can be introduced into the embossing space in the same movement, if the plate 26 is provided with corresponding receptacles.

Contrary to the embodiment illustrated in FIGS. 2 to 5, the receptacles 27, 28 can also be guided to and away from the embossing station on a straight path. It is essential that they are at the embossing station at the commencement, illustrated in FIG. 3, of the operation and thereafter (FIG. 4 or 5) leave the station on a path on which they come out of engagement with the forming segments 11, 16, 17.

A wide variety of edge forms can be achieved by the above-described method and device 6. For example, in the simplest form, the edge can be embossed in order to eliminate a stamping burr. Moreover, the edge may be provided with lettering and decoration. This may be both raised and recessed. Furthermore, the edge can be provided with a groove, in which a pattern, lettering, in particular also raised lettering, can be arranged.

Both round and polygonal coins or round blanks can be machined or upset at their edge. If non-round coins or blanks for these are to be machined, clamping or fixing means can be provided in or on the pockets of the receptacles 27, 28 clamping or fixing means, by which the coins or blanks can be, at least temporarily, mounted rotationally fixed.

Figure 6:
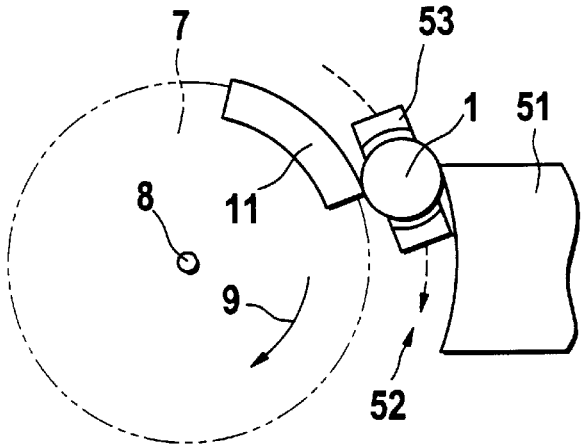
FIG. 6 is a schematic top view of a modified embodiment of the device for embossing the edge of round blanks.

A modified embodiment of the device according to the invention is in FIG. 6. The forming wheel 7 is configured identically to the embodiment shown in FIG. 2. That is, it has one or more roll-forming segments 11 which emboss part of the circumference of the round blank 1 and, for this purpose, the segments are provided with a corresponding profile. The abutment element for the forming wheel 7 is not formed by forming wheels 14, 15 as in the above embodiments, however, but by a fixed abutment element 51 which, with the circular arc defined by the rolling segment 11, defines a nip 52 of essentially constant width.

The length of the nip 52 corresponds essentially to half the circumference of the blank to be embossed. The blank is held in a receptacle 53, out of which it projects both radially inwards and radially outwards with respect to the rotation axis 8 of the forming wheel 7. Thereby the blank can come into contact both with the roll-forming segment 11 and with the abutment forming segment 51. The abutment forming segment 51 carries, on its side facing the forming wheel 7, a profile which supplements the profile of the roll-forming segment 11 so as to form the complete circumferential profile which is to be shaped onto the edge of the blank 1.

The receptacle 53 is guided, on a plate or another device, at least in portions, on an arcuate path leading through the embossing nip 52. The rotational speed is lower than that of the forming wheel 8 and, when the round blank 1 is in the embossing nip 52, corresponds to the speed at which the round blank 1 runs through the embossing nip 52 under the driving action of the forming wheel 8.

Figure 7:
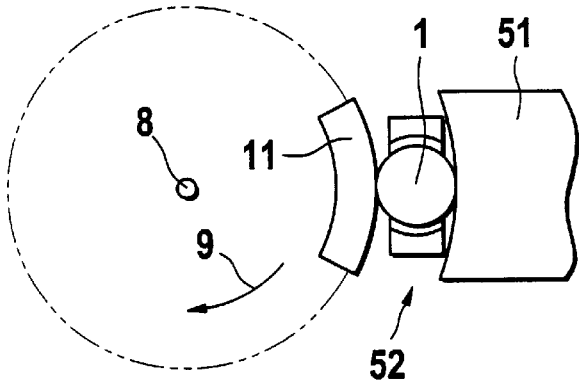
FIGS. 7 and 8 are schematic top views of the device similar to FIG. 6 but in different work stages.
Figure 8:
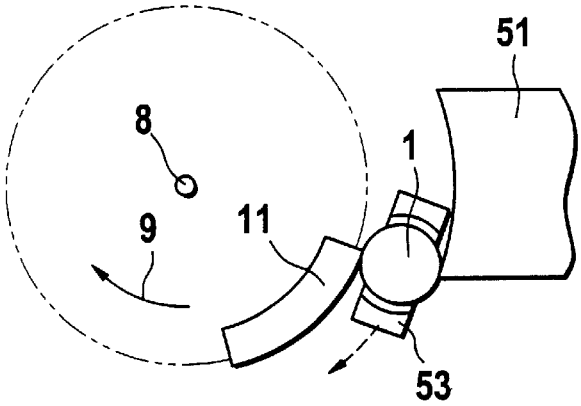

The embossing operation is illustrated in FIGS. 6, 7 and 8. While the round blank 1 is being reformed in the middle of the embossing nip 52 in FIG. 7, the reforming operation is terminated in FIG. 8 and the round blank 1 can then be removed from the receptacle 53.

In summary, a device for embossing the edge of round blanks, in particular coins according to the present invention has a forming wheel which is provided with roll-forming segments 11. The forming wheel 7 is assigned abutment elements 16, 17 which may likewise be mounted on forming wheels 14, 15. A positioning apparatus 26 guides the round blanks 1, in coordination with the equally directed synchronous rotation of the forming wheels 7, 14, 15, between the forming wheels and, after edge embossing has taken place, out of the wheel interspaces.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A device for embossing the edge of round blanks, comprising at least one forming wheel rotatably mounted about a rotation axis, operatively connected to a drive and configured with roll-forming segments having an effective length which extends by a predetermined angular amount about the rotation axis, and at least one abutment element with at least one shaping segment having an effective length which is dimensioned at least to supplement the roll-forming elements of the forming wheel and to form a complete circumference of the round blank such that a circumference of the round blank are contacted by the roll-forming segments only once per complete rotation.

2. The device according to claim 1, wherein the effective length of the at least one shaping segment is dimensioned to supplement the roll-forming elements of the forming wheel and to form a complete circumference of the round blank.

3. The device according to claim 1, wherein a positioning apparatus is operatively arranged between the at least one forming wheel and the at least one abutment element and is configured to receive and guide the round blanks.

4. The device according to claim 3, wherein the positioning apparatus has a carrier plate or a carrier-ring segment having pockets for receiving the round blanks.

5. The device according to claim 1, wherein the effective length of the roll-forming segments corresponds to half a circumference of the round blanks.

6. The device according to claim 1, wherein the roll-forming segments are arranged on an outer circumference of the forming wheel.

7. The device according to claim 1, wherein the roll-forming segments are arranged on a flat side of the at least one forming wheel.

8. The device according to claim 1, wherein the at least one abutment element is a forming wheel rotatably mounted about a second rotation axis, is drive-connected to a drive and is provided with roll-forming segments.

9. The device according to claim 8, wherein the roll-forming segments are arranged adjustably on an outer circumference of the at least one forming wheel, and the rotation axes of the forming wheels are arranged parallel to one another.

10. The device according to claim 1, wherein the roll-forming segments are arranged on a flat side of the at least one forming wheel and rotation axes of the at least one forming wheel are arranged at an angle to one another.

11. The device according to claim 1, wherein the at least one abutment element has a fixedly arranged rolling segment and spaced from the at least one forming wheel.

* * * * *